United States Patent [19]

Fryer

[11] 4,096,465

[45] Jun. 20, 1978

[54] ELECTRICAL OVERLOAD SWITCHING RELAY

[75] Inventor: Paul Chalfont Fryer, Bedford, England

[73] Assignee: Cutler-Hammer, Inc., Milwaukee, Wis.

[21] Appl. No.: 760,174

[22] Filed: Jan. 17, 1977

[30] Foreign Application Priority Data

Feb. 25, 1976 United Kingdom ..... 7466/76

[51] Int. Cl.[2] ..... H01H 71/16

[52] U.S. Cl. ..... 337/49; 337/46

[58] Field of Search ..... 337/49, 48, 47, 46

[56] References Cited

U.S. PATENT DOCUMENTS

| | | | |
|---|---|---|---|
| 2,872,548 | 2/1959 | Christensen | 337/49 |
| 3,451,024 | 6/1969 | Fantini | 337/46 |
| 3,792,401 | 2/1974 | Anderson | 337/49 |

FOREIGN PATENT DOCUMENTS

| | | | |
|---|---|---|---|
| 1,199,868 | 9/1965 | Germany | 337/49 |
| 994,436 | 6/1965 | United Kingdom | 337/49 |

*Primary Examiner*—Harold Broome

*Attorney, Agent, or Firm*—Hugh R. Rather; William A. Autio; Michael E. Taken

[57] ABSTRACT

An overload switching relay for a multi-phase electricity supply responds to the value of the currents in the individual phases and actuates a contact-breaking switch in the event of either (i) the mean value of the currents on all phases exceeding a first threshold, and (ii) any differential arising, above a second threshold, between the currents of any two phases: means are provided to increase the threshold to differential actuation as the mean value of the entire plurality of currents increases.

12 Claims, 6 Drawing Figures

ELECTRICAL OVERLOAD SWITCHING RELAY

This invention relates to an electrical overload switching relay for protecting a load which is connected to a multi-phase supply. The invention relates particularly to a relay which includes a switch actuated (a) in the event of the current on all phases of the supply to the load exceeding a threshold and (b) in the event of a differential, above a second threshold, between the currents of any two phases.

In certain circumstances it would be undesirable for the threshold to differential actuation to be of a constant value regardless of the setting or calibration of the threshold to balanced overload and regardless of the mean of the instantaneous currents on all phases: at the higher setting or calibration values of the threshold to balanced overload, or at the higher mean current values, the threshold to differential currents would be relatively small when measured as a percentage of the mean currents of all phases and therefore at these high settings or mean current values the relay would be relatively sensitive to such differentials. This degree of sensitivity is not necessary and not desirable in the sense that the relay would switch in the event of some current conditions which are in fact satisfactory to the load.

According to this invention, there is provided a plural-phase overload switching relay, comprising means responsive to the currents of the individual phases and a contact-breaking switch arranged to be actuated by the current responsive means in the event of the mean of the currents on all phases exceeding a threshold and to be actuated in the event of a differential, above a second threshold, between the currents of any two phases, the arrangement being such that the threshold to differential actuation increases with the mean of the currents of all phases.

In an embodiment to be described herein, the invention is applied to a thermal overload relay intended to protect a three-phase electric motor. Three bimetal strips are arranged to deflect according to the currents in the three individual phases and the free, deflecting ends of the bimetal strips being located in aligned slots in a pair of overlying plates which are supported for longitudinal movement. An actuating lever is pivoted at spaced points to the respective plates for rotation to actuate a contact-breaking switch in the event of relative longitudinal movement between the plates: such movement is brought about either by balanced currents in the three phases exceeding a threshold (which may be adjusted) or by a differential above a second threshold arising between any two phases.

The arrangement according to the present invention, wherein the threshold to differential actuation increases with the mean of the currents of all phases, advantageously de-sensitises the relay in respect of the differential threshold towards the higher mean values of the currents on all phases.

An embodiment of the invention will now be described by way of example only, with reference to the accompanying drawings, in which.

Figure 4:
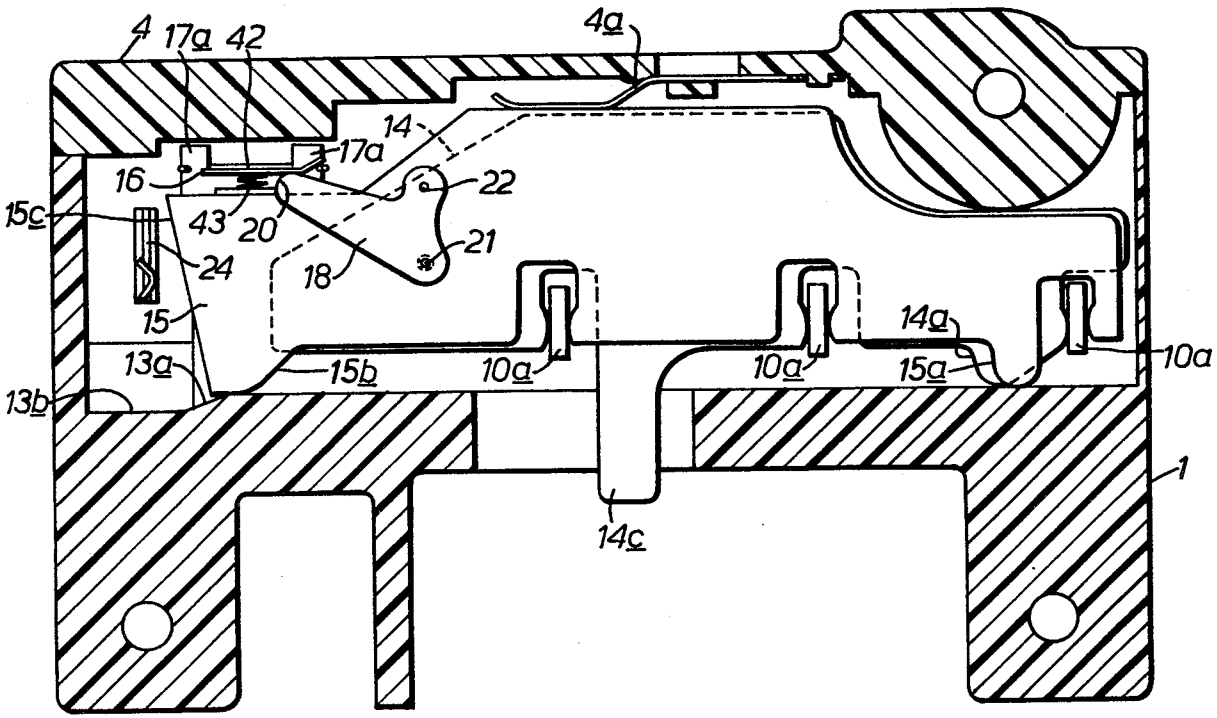
FIG. 4 is a section on the line IV—IV of FIG. 2.
Figure 5A:
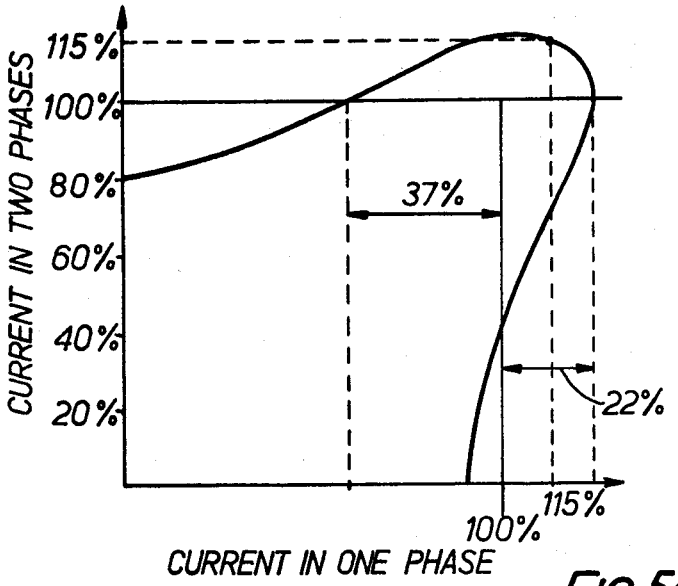
Figure 5B:
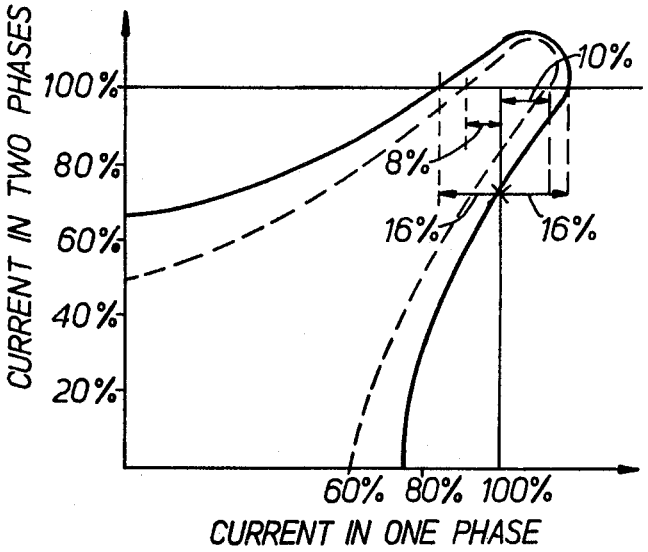

FIGS. 5(*a*) and 5(*b*) are curves illustrating the response of the relay of FIGS. 1 to 4 to different applied currents.

Referring to FIGS. 1 to 4 of the drawings, there is shown a thermal overload relay which is intended to be connected in a three-phase power supply to a three-phase motor and includes means responsive to the currents in the individual phases and a contact-breaking switch arranged to be actuated by the current responsive means (a) in the event of the current on all three phases exceeding a threshold and (b) in the event of a differential, above a second threshold, between the currents on any two phases. The relay shown in the accompanying drawings is arranged, as will be described herein, such that the magnitude of the second (or differential) threshold increases with the mean value of the currents of all phases.

The relay comprises a moulded housing 1 of plastics material with three internal partitions 1*a* forming three compartments 2 containing respective bimetal strips 10 and a fourth compartment 3 containing a switch. The open top side of the housing is closed by a moulded plastics cover plate 4. The bimetal strips may be heated directly by the flow of current therethrough, each bimetal strip having two limbs one fixed to a metal bracket 12 itself fixed to the floor of the respective housing compartment 2 and including an external terminal 8. The other limb of the bimetal strip is connected by a flexible lead 11 to an external terminal 9. Alternatively the bimetal strips may be heated indirectly by a heater connected between terminals 8 and 9 and lying adjacent the bimetal strip. Each heater is intended for connection, by means of its associated terminals 8 and 9, in series with a respective phase of the three-phase supply to the electric motor. Accordingly, the three bimetal strips are responsive to the heat generated within the respective heater elements and therefore the current flowing in the respective phases. The arrangement of the bimetal strips is such that as the currents flowing in the respective phases increase, the free ends 10*a* of the bimetal strips will move to the left, as viewed in FIG. 2.

The partitions 1*a* terminate short of the rear wall of the housing and a transverse compartment 13 exists which is common to the compartments 2 and 3. A pair of generally elongate overlying plates 14 and 15 of insulating material is disposed within the compartment 13 and these plates include aligned slots through which project the ends 10*a* of the bimetal strips, the plates being supported for longitudinal sliding movement within the compartment 13. FIG. 4 shows the general contours of the plates 14 and 15 and of their slots: in particular it will be seen that plate 14 includes a foot 14*a* adjacent one end thereof for sliding over the floor of the compartment 13, whilst plate 15 includes a foot 15*a* adjacent the same end and a foot 15*b* adjacent the opposite end. It will be seen that the floor of compartment 13 is at one level except for a ramp 13*a* leading to a lower lever 13*b*: in operation the foot 15*b* of the plate 15 may slide over the ramp 13*a* and lower level 13*b*, as will be described. A leaf spring 4*a* is secured at one end thereof to the lower side of the cover plate 4 and its other end is arranged to press upon the overlying plates 14 and 15 so that the feet 14*a* and 15*a*, 15*b* of these press onto the floor of the compartment 13.

Figure 1:
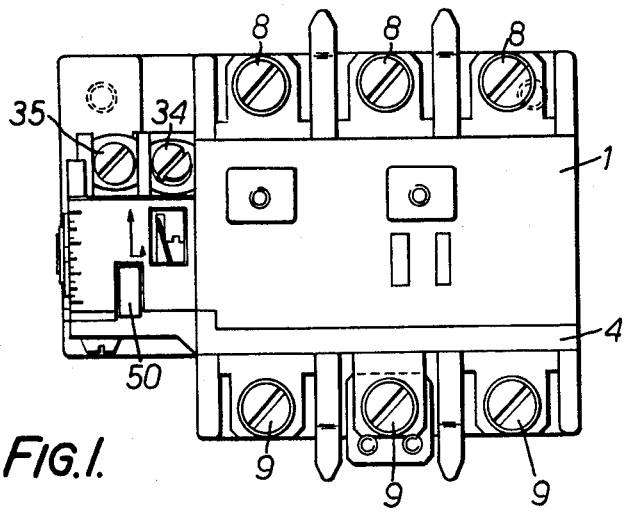
FIG. 1 is a front elevation of an overload relay.
Figure 2:
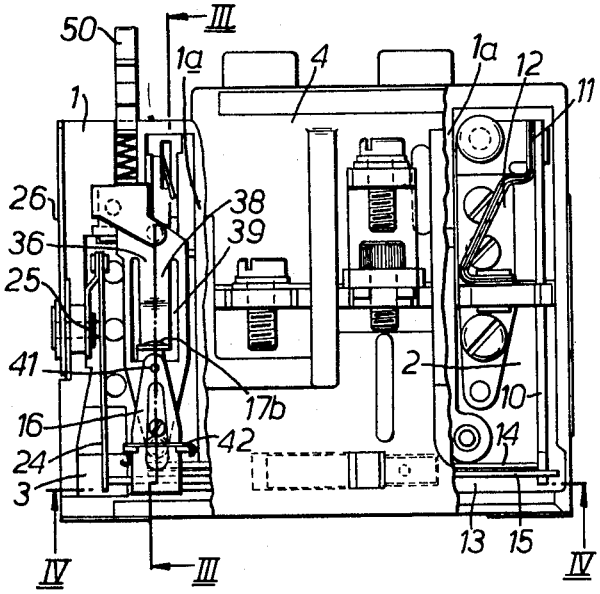
FIG. 2 is an elevation of the top of the overload relay of FIG. 1, with portions of a cover plate of the relay cut-away to show internal details of the relay.
Figure 3:
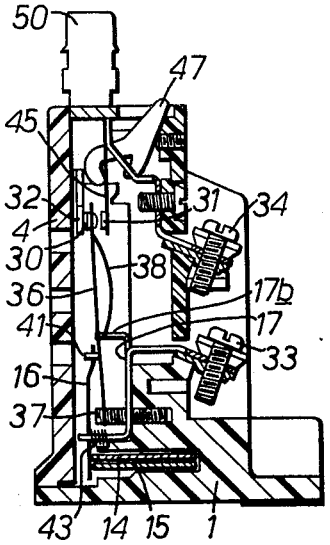
FIG. 3 is a section on the line III—III of FIG. 2.

The plate 15 includes an inclined edge 15*c* which, in operation, may abut the end of a further bimetal strip 24 carried by a boss 25 which can be turned by movement of an external lever 26 (see FIG. 2). Alteration of the position of the lever 26 alters the point along the inclined edge 15*c* with which the bimetal strip 24 will be aligned. An actuating lever 18, for the switch which is disposed within the compartment 3, is pivoted at 21 to the plate 14 and at 22 to the plate 15 and includes a nose 20 which, in the position shown, rests against a rocking lever 16 of the switch itself. Plate 14 includes a projection 14*c* for manual testing of the switch.

The switch within the compartment 3 includes the rocking lever 16 which is mounted for rocking about an axis which is transverse to the length of the rocking lever 16 and intermediate its ends. Thus, the rocking lever 16 is urged by a coil compression spring 43 against a straight middle portion of a wire spring clip 42, hooked ends of which engage respective notches in two upstanding arms 17*a* of a metal bracket 17 which is secured within compartment 3. The switch further comprises a snap-acting arm in the form of a spring blade 36, carrying a contact 30 at a free end thereof. The other end of the spring blade 36 is engaged in an annular recess immediately beneath the head of a set screw 37 which is in threaded engagement with the bracket 17. A "U"-shaped aperture 39 is formed in the spring blade 36 and an upstanding arm 17*b* of the bracket 17 extends through this aperture: a tongue 38 of the spring blade 36 is formed into a "C" spring the free end of which engages a locating recess in the arm 17*b*. A grub screw 41 is threaded through the rocking lever 16 at the end thereof opposite the actuating lever 18 and this grub screw bears at its pointed end onto the spring blade 36.

The switch further comprises a fixed contact 32 with which the contact 30 is normally in contact, and a contact 31 which is carried at one end of a spring blade 45 and which may be flexed by a manually movable lever 47 to move the contact 31 from the position shown to a position further from the fixed contact 32. Contact 30 is connected electrically to an external terminal 33 through the spring blade 36 and bracket 17 and contacts 31 and 32 are connected to respective terminals 34 and 35. In the position of the contact 31 shown, upon actuation the contact 30 will strike the contact 31 but will return automatically to fixed contact 32 when the bimetals 10 have cooled: when instead the contact 31 is moved to its position further from the fixed contact 32, the spring blade 36 will snap overcentre to remain in contact with contact 31. A push button 50 is provided to reset the spring blade 36 from this latter position.

In use of the relay, the terminals 8 and 9 of the heater elements are connected in series with the respective phases of the supply to the electric motor being protected. Terminals 33 and 35 are connected in circuit with control gear of the motor in such a manner that when the contact 30 breaks from the fixed contact 32, the electrical supply to the motor is interrupted. Terminals 33 and 34 may be connected in an auxiliary circuit, for example an alarm or indicator, for that auxiliary circuit to be energised when the contact 30, upon breaking from the fixed contact 32, makes with the adjustable contact 31.

In operation, as the currents in the three phases increase, the bimetal strips will be progressively heated and will deflect progressively towards the left, as seen in FIGS. 2 and 4. If all currents exceed a threshold or if the currents become unbalanced so that a differential above a second threshold exists between any two phases, then the rocking lever 16 of the switch will be rocked by the actuating lever 18, so actuating the switch to break the contacts 30 and 32. Thus, in the event of balanced excess currents, as the bimetal strips progressively deflect they drive the plate 14 to the left (as shown in FIG. 4) and plate 15 follows, being drawn by plate 14 through the medium of the actuating lever 18: during this stage the actuating lever 18 slides across the rocking lever 16 but does not apply sufficient force to rock the latter. Eventually the edge 15*c* of the following plate 15 abuts the bimetal strip 24, preventing further movement of the plate 15, whereafter further movement of plate 14 under the drive of the bimetals 10 causes rotation of the actuating lever 18 to rock the rocking lever 16 and thereby actuate the switch to break the contacts 30 and 32. In the event of unbalanced currents, the bimetal 10 associated with the higher phase current will drive or hold the plate 14 to the left, as seen in FIG. 4, whilst the bimetal 10 associated with the lower phase current will hold or drive the plate 15 to the right, causing the lever 18 to rotate and, if the differential between the higher and lower current exceeds a threshold, to actuate the switch and break the contacts 30 and 32.

The extension 14*c* of the plate 14 provides a means for manually testing the switch. The bimetal strip 24 has the same temperature/deflection characteristics as the bimetal strips 10 so as to compensate for changes in ambient temperature. Movement of bimetal strip 24 by means of the external lever 26 adjusts the threshold current at which the switch will be actuated in response to a balanced overload.

It will be particularly noted that, as the plate 15 moves to the left as viewed in FIG. 4, its foot 15*b* slides firstly on the level floor of compartment 13 but will, if the movement is sufficient, then slide down the ramp 13*a* and possibly then over the lower level 13*b*: at all stages the foot 15*b* is urged into abutment with the floor and ramp by the spring 4*a*. The effect of the foot 15*b* sliding down the ramp 13*a* is to progressively pivot the plate 15 in the counter-clockwise direction, as viewed in FIG. 4, about its foot 15*a*, and this progressively rotates the actuating lever 18 in the counter-clockwise direction. Accordingly the nose 20 moves progressively further from the rocking lever 16 and therefore a progressively larger differential is necessary between any two phase currents before the actuating lever will rock the lever 16 to actuate the switch. By this arrangement, the threshold for differential actuation increases as the mean value of the currents of all phases increases.

The plate 15 will be increasingly affected by the ramp 13*a* as the maximum current setting is increased (by adjustment of the bimetal strip 24), because the plate 15 has an increasing distance to move before abutting the bimetal strip 24. The arrangement may be such that the foot 15*b* will not reach the ramp when the relay is adjusted to the lower maximum current settings. For the highest maximum current setting, the arrangement may be such that the foot 15*b* will not reach as far as the lower level 13*b*. It will be seen that the operation in respect of balanced overload currents is not modified by the ramp 13*a*, but that the operation in respect of unbalanced currents is de-sensitised towards higher mean currents. In the example shown, the ramp 13*a* is linear. FIG. 5 illustrates the principles of this de-sensitising effect. The two curves (a) and (b) relate to when the relay is adjusted, by bimetal strip 24, to the lowest and to the highest calibrations (or balanced currents threshold settings) respectively. In the relay shown, there is a ratio of 1:1.6 between the lowest and highest settings.

Each curve represents a plot of the currents in two phases against the current in the third phase, measured as percentages of the calibration or threshold setting. Each curve in effect demarcates the points at which actuation of the switch will occur in moving from the region (beneath the curve) where no actuation will occur. Curve *b* shows in dotted outline what the situation would be if the floor of the compartment 13 were at the higher level throughout, whilst the full curve shows the actual situation and the difference is caused by the ramp 13*a*.

Regarding the dotted curve in FIG. 5(*b*), it will be seen that in the absence of the effect of ramp 13*a* the relay would be much more sensitive to differential unbalances, expressed as a percentage of the calibration, at the higher settings than at the lower settings and this could result in the relay being actuated unnecessarily. The effect of the ramp 13*a* is to reduce this sensitivity at the higher calibrations, avoiding such nuisance-actuations. For the example illustrated, the balanced overload switching occurs at approximately 115% of the calibration, whether minimum or maximum. With 100% on each of the three phases, then at the minimum calibration the third phase may reduce by 37% or increase by 22% before actuation to the unbalance. At the maximum calibration, the effect of the de-sensitising ramp is that the third phase may reduce by 16% (instead of 8%) or increase by 16% (instead of 10%) before actuation to the unbalance.

I claim:

1. An overload switching relay for a multi-phase electric supply, comprising:

(a) a plurality of pairs of terminals connectable in series in respective phases of the electric supply;

(b) a plurality of conductive paths, one for each pair of terminals, the conductive paths being connected in series between their respective terminals;

(c) a plurality of current responsive means, one for each conductive path, responsive to respective phase currents flowing in the respective conductive paths;

(d) a threshold means coupled to the plurality of current responsive means, said threshold means being responsive to a mean value of the currents on all phases exceeding a first threshold and being also responsive to any differential, above a second, differential threshold, between the currents of any two phases;

(e) said threshold means including means to increase said second, differential threshold with an increase in the mean value of the currents of all phases; and (f) a contact-breaking switch coupled to said threshold means to be actuated when said threshold means responds to either of the mean value of all currents on all phases exceeding the first threshold and to any differential, above said second threshold, between the currents of any two phases.

2. A relay as claimed in claim 1, in which said threshold means includes means to pre-set said first threshold.

3. A relay as claimed in claim 1, in which said second, differential threshold increasing means increases said second, differential threshold linearly with increase in the mean value of the currents of all phases, at least over a range of said mean values.

4. An overload switching relay for a multi-phase electric supply, comprising:

(a) a plurality of pairs of terminals connectable in series in respective phases of the electric supply;

(b) a plurality of resistance heaters, one for each pair of terminals, connected in series between their respective terminals;

(c) a plurality of bimetal strips, one for each resistance heater, arranged to be heated by the respective heaters and to deflect according to the currents in the respective phases;

(d) a pair of overlying plates mounted for sliding movement in their own planes;

(e) a plurality of slots in each plate, the slots in one plate being aligned with respective ones of the slots in the other plate;

(f) each bimetal strip extending through a respective slot of the one plate and through the aligned slot of the other plate, with each bimetal strip tending to slide the plates in one direction in response to increasing current in the respective phase and in the opposite direction in response to decreasing current in the respective phase;

(g) an actuating lever pivoted at spaced points thereof to the respective plates, to rotate, in a plane parallel to the planes of the plates, in response to differential sliding movement of said plates;

(h) an abutment limiting sliding movement of said one plate in said one direction;

(i) a contact-breaking switch coupled to said lever to be actuated by a threshold degree of rotation of said lever in one sense in the event of either said one plate abutting said abutment but said other plate being slid further in said one direction by at least one bimetal strip, representing a condition wherein a mean value of the currents on all phases exceeds a first threshold, and movement of said one plate in said one direction being arrested by one bimetal strip and movement of said other plate in the one direction being continued by another bimetal strip, representing a condition wherein a differential, above a second, differential threshold, exists between two phases; and (j) means to increase said second, differential threshold with an increase in the mean value of the currents of all phases.

5. A relay as claimed in claim 4, in which said abutment is movable to pre-set the extent of sliding movement, in said one direction, that said one plate is limited to.

6. A relay as claimed in claim 5, in which said one plate comprises an end which is inclined to a line perpendicular to the line of said sliding movement and in which said abutment is movable, for pre-setting, parallel to said perpendicular.

7. A relay as claimed in claim 5, in which said abutment comprises a bimetal strip arranged to deflect in a like manner to said plurality of bimetal strips to compensate for ambient temperature variations.

8. A relay as claimed in claim 4, in which said second, differential threshold increasing means comprises means mounting said one plate for movement transverse to its line of sliding, but in its own plane, increasing movement of said one plate in said one direction causing progressive transverse movement of said one plate and progressive rotation of said lever in a sense opposite to said one sense.

9. A relay as claimed in claim 4, in which said second, differential threshold increasing means comprises means mounting said one plate for movement transverse to its line of sliding, but in its own plane, a foot projecting from said one plate, a ramp surface extending transverse to the plane of said one plate and inclined to the line of sliding of said one plate, said foot sliding on said surface.

10. A relay as claimed in claim 9, comprising two spaced surfaces extending transverse to the plane of said one plate and parallel to its line of sliding, said ramp surface joining said two spaced surfaces.

11. A relay as claimed in claim 9, in which said ramp surface is linearly inclined.

12. A relay as claimed in claim 9, comprising means resiliently biassing said foot against said ramp surface.

* * * * *